US005176537A

United States Patent [19]

Samejima et al.

[11] Patent Number: 5,176,537

[45] Date of Patent: Jan. 5, 1993

[54] METAL TERMINAL RETAINING CONSTRUCTION

[75] Inventors: Masakuni Samejima; Takayuki Yamamoto, both of Shizuoka, Japan

[73] Assignee: Yazaki Corporation, Tokyo, Japan

[21] Appl. No.: 812,987

[22] Filed: Dec. 24, 1991

[30] Foreign Application Priority Data

Dec. 26, 1990 [JP] Japan ..... 2-404664[U]

[51] Int. Cl.[5] ..... H01B 13/40

[52] U.S. Cl. ..... 439/595; 439/598; 439/752

[58] Field of Search ..... 439/595, 598, 599, 752

[56] References Cited

U.S. PATENT DOCUMENTS

| | | | |
|---|---|---|---|
| 4,944,695 | 7/1990 | Tsuji et al. | 439/595 |
| 5,085,598 | 2/1992 | Kinoshita | 439/595 |
| 5,088,938 | 2/1992 | Murakami et al. | 439/595 |
| 5,100,346 | 3/1992 | McCardell | 439/595 |

*Primary Examiner*—Paula A. Bradley
*Attorney, Agent, or Firm*—Sughrue, Mion, Zinn, Macpeak & Seas

[57] ABSTRACT

A connector for retaining a metal terminal having an engagement portion therein. The connector includes a connector housing having a terminal receiving hole for receiving the terminal therein. The connector housing has a flexible retaining member extending therefrom which is engageable with the engagement portion of the terminal when the terminal is in a completely engaged position. A retaining reinforcement member is insertable into the connector housing to retain the flexible retaining member engaged in the terminal. Specifically, the reinforcement member includes a groove defined by opposing retaining walls. When the reinforcement member is inserted into the connector housing, the flexible retaining piece is positioned in the groove and surrounded on opposite sides by the retaining walls which prevent lateral displacement of the retaining member.

10 Claims, 4 Drawing Sheets

METAL TERMINAL RETAINING CONSTRUCTION

BACKGROUND OF THE INVENTION

1. Field of the Invention

This invention relates to a metal terminal retaining device which uses a flexible retaining member for retaining a metal terminal in a terminal receiving chamber of a connector used for connecting, for example, wire harnesses of an automobile.

2. Background

FIG. 6 illustrates a connector for retaining a terminal therein. As illustrated, a terminal d having a wire c connected thereto is inserted into a terminal receiving chamber b of a connector housing a, so that a projection f of a flexible retaining piece e engages an annular retaining groove o provided in the terminal d. Thereafter, a spacer k is inserted into space h to prevent downward displacement of the flexible retaining piece e, thereby securely retaining the terminal. Such a device is disclosed in Japanese Patent Publication No. 54-11515.

In the above connector, although the spacer k prevents a downward flexible displacement of the flexible retaining piece e, the spacer does not prevent a displacement of the flexible retaining piece e in the lateral direction (i.e., into and out of the paper in FIG. 6).

In view of the above problem, it is an object of this invention to provide a metal terminal retaining device in which a retaining reinforcement member for a flexible retaining piece is inserted into a connector housing to securely retain the flexible retaining piece, thereby overcoming the above problem.

SUMMARY OF THE INVENTION

The above object of the present invention has been achieved by a metal terminal retaining connector for a connector housing wherein an engagement portion is provided on a metal terminal received in a terminal receiving chamber of the connector housing; a flexible retaining piece is formed integrally with the connector housing; and a distal end portion of the flexible retaining piece is engaged with the engagement portion of the metal terminal. According to the invention, a retaining reinforcement member having a groove formed therein and extending in its longitudinal direction is provided. A pair of inner surfaces of the groove are disposed at such a position as to retain the distal end portion of the flexible retaining piece therebetween so as to prevent lateral movement of the retaining piece.

DETAILED DESCRIPTION OF THE PREFERRED EMBODIMENTS

Figure 1:
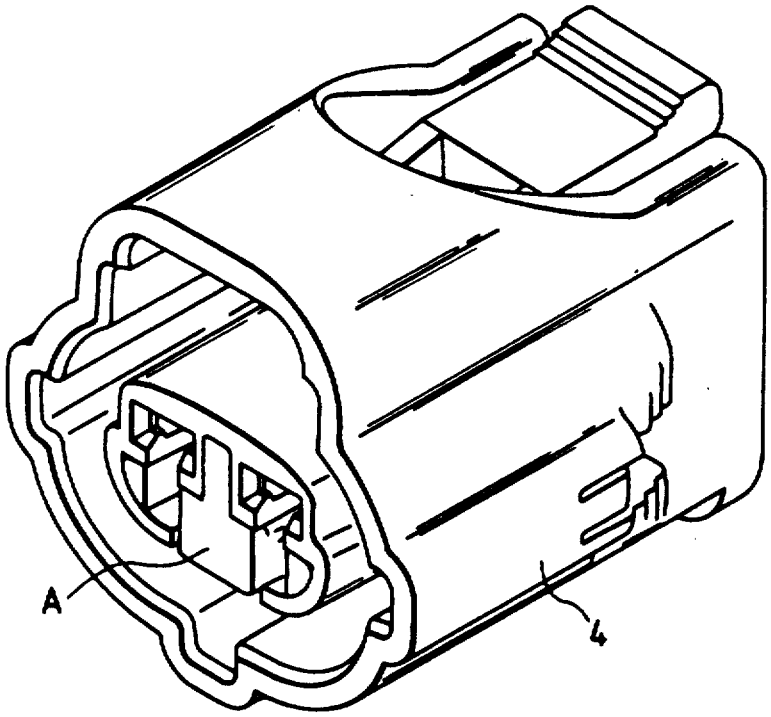
FIG. 1 is a perspective view of a connector housing according to the present invention.
Figure 2:
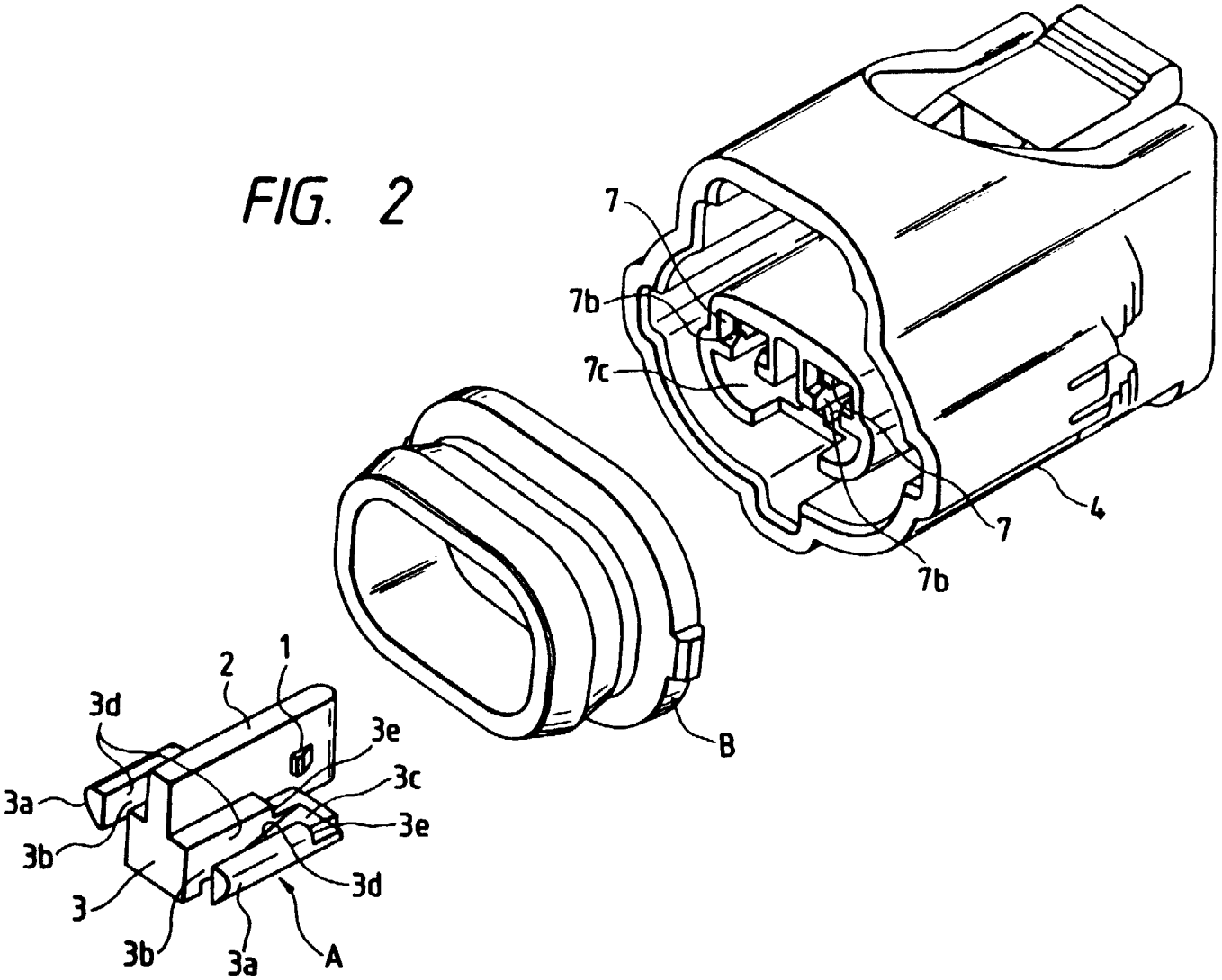
FIG. 2 is an exploded perspective view of the connector housing of the present invention.

Referring to FIGS. 1 and 2, the connector includes a retaining reinforcement member A, a packing B, and a connector housing 4. The retaining reinforcement member A includes a rib 2 extending from a main body 3. Projections 1 are provided at a front end portion of the rib for engaging engagement portions (not shown) formed on the inner wall of the connector housing 4 to retain the reinforcement member at predetermined positions, as described below. The main body portion 3 includes outer edge portions 3*a* having a generally semicircular cross-section. A groove 3*b* is formed midway between the rib 2 and each outer edge portion 3*a* of the main body portion 3, and extends in the longitudinal direction thereof.

The connector housing 4 includes two engagement portions at two different positions. The first engagement portion is disposed at a position at which the retaining reinforcement member A is partially inserted into in the connector housing 4 and retained in that position, and the second engagement portion is disposed at a position at which the retaining reinforcement member is completely inserted into the connector housing and retained in that position.

Figure 4:
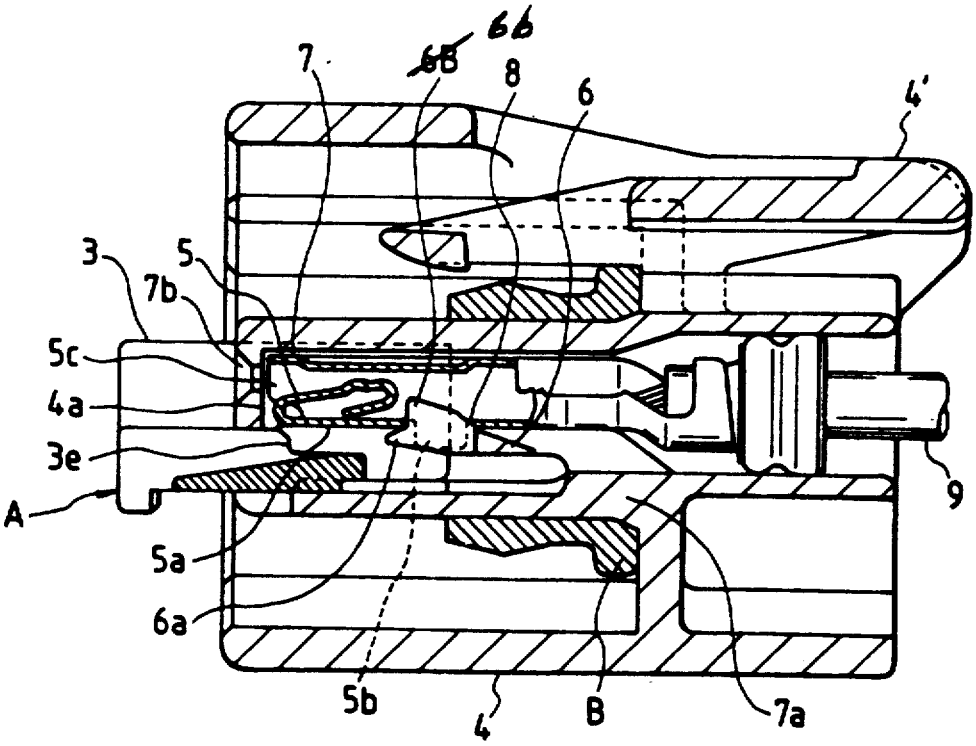
FIG. 4 is a vertical cross-sectional view of the connector housing, showing the condition in which the retaining reinforcement member of the present invention is provisionally retained.
Figure 5:
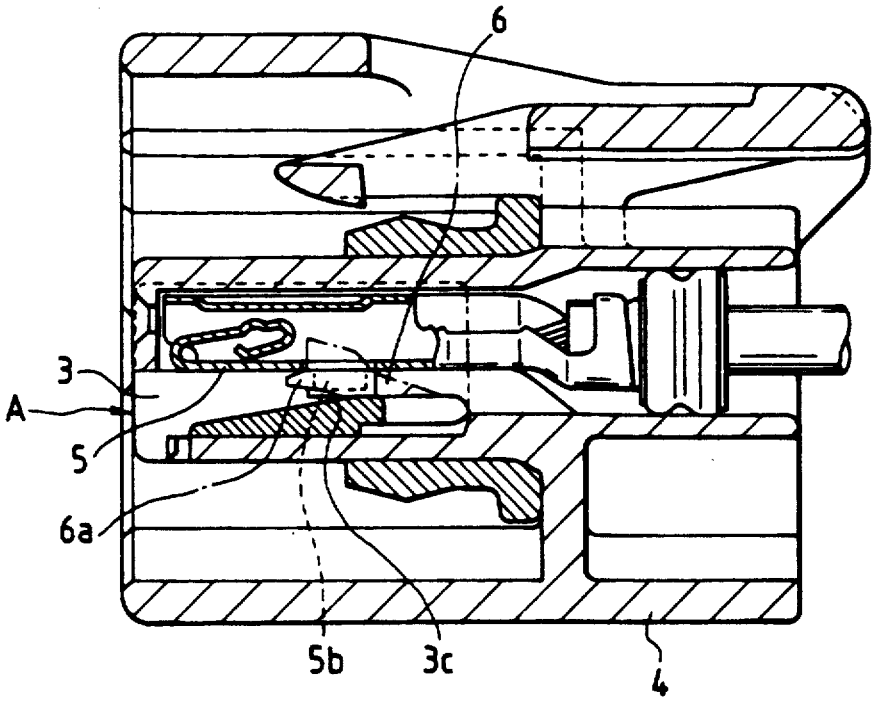
FIG. 5 is a vertical cross-sectional view of the connector housing, showing the retaining reinforcement member in the completely retained position.
Figure 6:
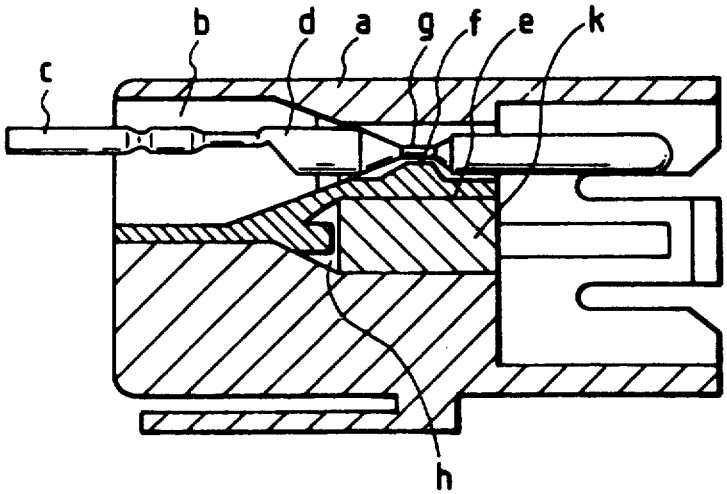
FIG. 6 PRIOR ART
FIG. 6 is a vertical cross-sectional view of a conventional connector for retaining a terminal in a connector housing.

The groove 3*b* is defined by an upwardly-slanting bottom surface 3*c* and opposed side surfaces 3*d* and 3*d*, as illustrated in FIG. 2. The distance between the side surfaces 3*d* and 3*d* is generally equal to, but slightly larger than, the width of a distal end 6*a* of a flexible retaining piece 6 for retaining a metal terminal 5, as illustrated in FIG. 4 and described below. The main body portion 3 includes a pair of stepped surfaces 3*e* and 3*e* formed midway along the longitudinal length thereof. The stepped surfaces are formed at such positions as to engage stabilizers 5*b*, described below, of the metal terminal 5 when the reinforcement member A is in the completely inserted position, as illustrated in FIG. 5.

As shown in FIGS. 2 and 4, two terminal receiving chambers 7 are provided in a side-by-side relationship in the connector housing 4. The connector is a two-pole waterproof male connector having a waterproof packing B at its outer peripheral portion, and including a locking arm 4' for a mating connector.

Referring to FIG. 4, a flexible retaining piece 6 projects from inner wall 7*a* of the terminal receiving chamber 7, and includes a retaining projection 6*b* at its distal end which engages a retaining hole 8 provided in the terminal 5 to thereby prevent rearward withdrawal of the metal terminal 5 (i.e., in the right-hand direction in FIG. 4). The retaining hole is a result of forming the opposed tongue-like stabilizers 5*b* (indicated by broken line in FIG. 4) on an electrical contact portion 5*a* of the female metal terminal 5 as a result of stamping. As illustrated in FIGS. 2 and 4, an insertion hole 7*c* for receiving the retaining reinforcement member A is provided in the connector housing 4 intermediate and below insertion holes 7*b* and 7*b* for receiving the mating terminals.

Figure 3:
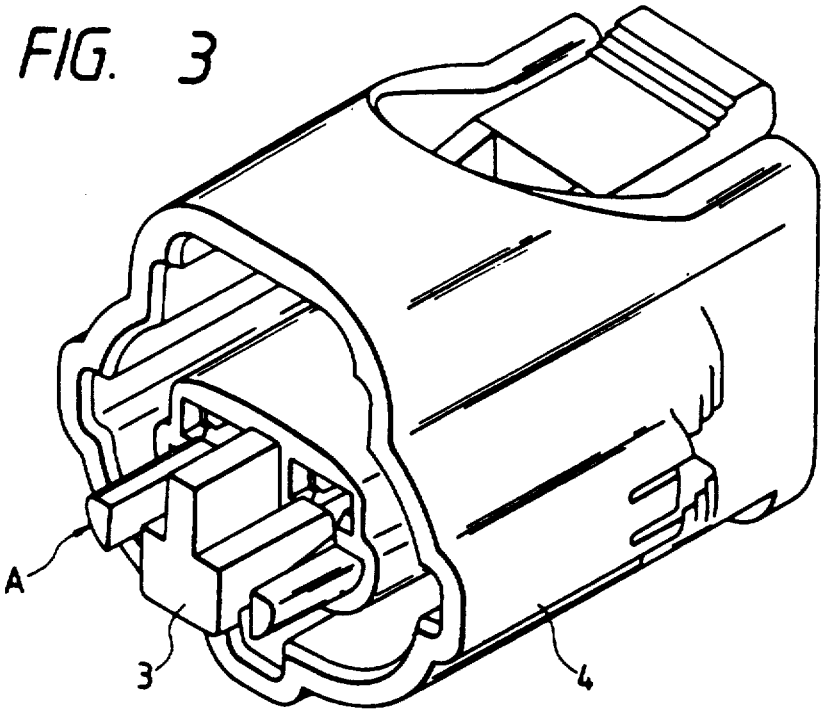
FIG. 3 is a perspective view of the connector housing, showing the condition in which a retaining reinforcement member of the present invention is provisionally retained.

The operation of connector according to the invention will now be described with reference to FIGS. 3, 4 and 5. FIG. 3 shows the condition in which the retaining reinforcement member A is inserted into the connector housing 4 in a provisionally-retained condition, with the projections 1 of the retaining reinforcement member A engaged with the first engagement portions (not shown) provided on the inner wall of the connector housing 4. Generally, in this condition, the connector housing 4 is supplied to the assembling site. FIG. 4 is a vertical cross-sectional view of the connector in the same condition as FIG. 3, and FIG. 5 is a vertical cross-sectional view showing the condition in which the retaining reinforcement member A is completely inserted into the connector housing 4 upon completion of the assembling.

In FIG. 4, in which the retaining reinforcement member A is disposed in the connector housing 4 in a provisionally-retained condition, the metal terminal 5 connected to a lead wire 9 is inserted into the terminal receiving chamber 7 from the rear side of the connector housing 4 (the right-hand side in FIG. 4). The retaining projection 6*b* of the flexible retaining piece 6, projecting from the inner wall 7*a* of the connector housing 4, is engaged in the retaining hole 8 formed through the electrical contact portion 5*a* of the metal terminal 5, as explained above. A distal end 5*c* of the metal terminal 5 is abutted against an end surface 4*a* of the terminal receiving chamber 7, and the metal terminal is retained by the retaining projection 6*b* against rearward movement. Therefore, the metal terminal is retained in the provisionally retained condition within the terminal receiving chamber 7.

The retaining reinforcement member A is thereafter further inserted such that the projections 1 engage with the second engagement portions (not shown) provided on the inner wall of the connector housing 4. In this position, the stepped surfaces 3*e* and 3*e* of the retaining reinforcement member A are abutted against the stabilizers 5*b* of the metal terminal 5, and the side surfaces 3*d* and 3*d*, defining the groove 3*b* formed in the main body portion 3, hold the distal end 6*a* of the flexible retaining piece 6 therebetween, as shown in FIG. 5. Therefore, the distal end 6*a* of the flexible retaining piece 6 is prevented from an accidental lateral displacement. Additionally, accidental downward displacement of the distal end 6*a* of the flexible retaining piece 6 is prevented by the bottom surface 3*c* of the groove 3*b* in the main body portion 3.

Although the above embodiment is designed to be used for the male connector, this invention can be applied to a female connector.

As described above, in the present invention, the flexible retaining piece is inserted to hold the side and lower surfaces of the retaining portion of the flexible retaining piece so as to particularly prevent the lateral displacement thereof, thereby preventing the accidental withdrawal and displacement of the metal terminal due to this lateral displacement.

What is claimed is:

1. A connector for retaining a metal terminal having an engagement portion provided therein, comprising:

a connector housing having an insertion hole, and a terminal receiving chamber provided therein for receiving said terminal, and including a flexible retaining member formed thereon and being engageable with said engagement portion of said terminal when said terminal is in a completely retained position; and a retaining reinforcement member insertable into said insertion hole of said connector housing, said reinforcement member having a groove provided therein defined by opposing retaining walls, said flexible retaining member being disposed within said groove and being retained between said retaining walls when said terminal is in said completely retained position to prevent movement of said flexible retaining member in a lateral direction of said connector.

2. The connector of claim 1, wherein a distance between said opposing retaining walls is slightly larger than a width of said retaining member.

3. The connector of claim 1, wherein said connector housing has two terminal receiving chambers for receiving a pair of terminals.

4 The connector of claim 1, wherein a distal end of said retaining member is engageable with said engagement portion of said terminal.

5. The connector of claim 1, wherein said reinforcement member includes a stepped surface disposed perpendicular to said retaining walls for abutting against said terminal to prevent longitudinal movement of said terminal further into said receiving chamber.

6. The connector of claim 1, wherein said retaining reinforcement member is retainable in a provisionally retained position disposed partially in said insertion hole of said connector housing and said completely retained position disposed completely in said insertion hole.

7. The connector of claim 1, wherein said retaining reinforcement member further includes a retaining surface disposed between said opposing retaining walls and partially defining said groove, said retaining surface abutting against a lower surface of said retaining member when said terminal is in said completely retained position.

8. The connector of claim 7, wherein said retaining surface is an inclined surface.

9. A connector for retaining a metal terminal having an engagement portion provided therein, comprising:

a connector housing having an insertion hole, and a terminal receiving chamber provided therein for receiving said terminal, and including a flexible retaining member formed thereon and being engageable with said engagement portion of said terminal when said terminal is in a completely retained position; and a retaining reinforcement member insertable into said insertion hole of said connector housing, said reinforcement member including means for simultaneously preventing displacement of said retaining member in two distinct directions.

10. The connector of claim 9, wherein one of said directions is a lateral direction with respect to said connector and the other direction is a vertical direction with respect to said connector.

* * * * *

US005176537A

REEXAMINATION CERTIFICATE (2581st)

United States Patent [19]

[11] B1 5,176,537

Samejima et al.

[45] Certificate Issued May 16, 1995

[54] METAL TERMINAL RETAINING CONSTRUCTION

[75] Inventors: Masakuni Samejima; Takayuki Yamamoto, both of Shizuoka, Japan

[73] Assignee: Yazaki Corporation, Tokyo, Japan

Reexamination Request:
No. 90/003,356, Mar. 11, 1994

Reexamination Certificate for:

| | |
|---|---|
| Patent No.: | 5,176,537 |
| Issued: | Jan. 5, 1993 |
| Appl. No.: | 812,987 |
| Filed: | Dec. 24, 1991 |

[30] Foreign Application Priority Data

Dec. 26, 1990 [JP] Japan ..... 2-404664

[51] Int. Cl.[6] ..... H01R 13/40

[52] U.S. Cl. ..... 439/595; 439/598; 439/752

[58] Field of Search ..... 439/595, 598, 599, 752

[56] References Cited

U.S. PATENT DOCUMENTS

| | | | |
|---|---|---|---|
| 4,944,695 | 7/1990 | Tsuji et al. | 439/595 |
| 4,973,268 | 11/1990 | Smith et al. | 439/595 |
| 4,975,082 | 12/1990 | Nagasaka et al. | 439/595 |
| 5,085,598 | 2/1992 | Kinoshita | 439/595 |
| 5,088,938 | 2/1992 | Murakami et al. | 439/595 |
| 5,100,346 | 3/1992 | McCardell | 439/595 |

FOREIGN PATENT DOCUMENTS

| | | |
|---|---|---|
| 63-137474 | 9/1988 | Japan . |
| 2-24466 | 2/1990 | Japan . |

*Primary Examiner*—Neil Abrams

[57] ABSTRACT

A connector for retaining a metal terminal having an engagement portion therein. The connector includes a connector housing having a terminal receiving hole for receiving the terminal therein. The connector housing has a flexible retaining member extending therefrom which is engageable with the engagement portion of the terminal when the terminal is in a completely engaged position. A retaining reinforcement member is insertable into the connector housing to retain the flexible retaining member engaged in the terminal. Specifically, the reinforcement member includes a groove defined by opposing retaining walls. When the reinforcement member is inserted into the connector housing, the flexible retaining piece is positioned in the groove and surrounded on opposite sides by the retaining walls which prevent lateral displacement of the retaining member.

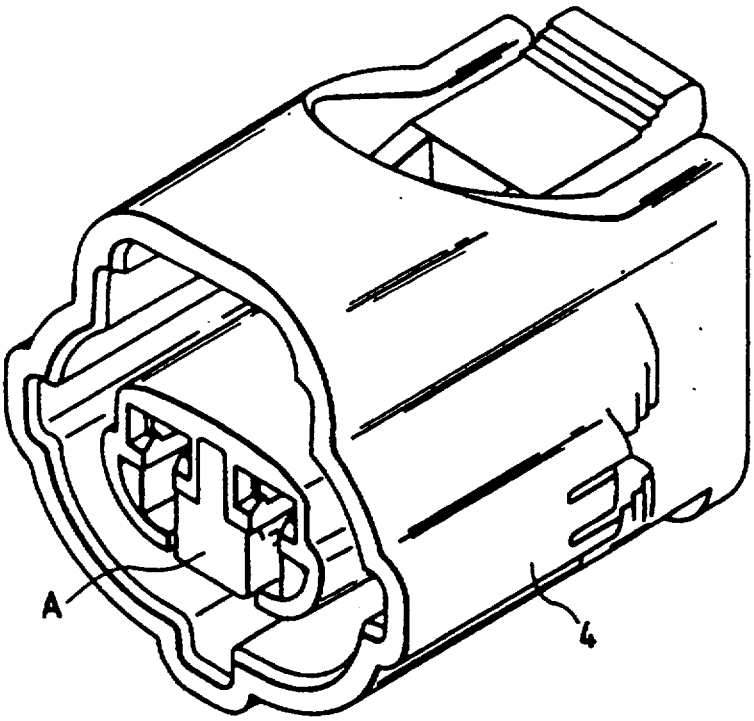

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 7, 8, 9 and 10 are cancelled.

Claim 1 is determined to be patentable as amended.

Claims 2–6, dependent on an amended claim, are determined to be patentable.

New claims 11, 12, 13, 14, 15 and 16 are added and determined to be patentable.

1. A connector for retaining a metal terminal having an engagement portion provided therein, comprising:

a connector housing have an insertion hole[,] and a terminal receiving chamber provided therein for receiving said terminal, and including a flexible retaining member formed thereon and being engageable with said engagement portion of said terminal when said terminal is in a completely retained position; and a retaining reinforcement member insertable into said insertion hole of said connector housing *in a first direction*, said reinforcement member having a *rectangular U-shaped* groove provided therein defined by opposing *planar* retaining walls *and a bottom planar retaining wall, wherein when said terminal is in said completely retained position* said flexible retaining member [being] *is* disposed within said groove [and being] *so as to be* retained between said retaining walls *and supported by said bottom retaining wall* [when said terminal is in said completely retained position] to prevent movement of said flexible retaining member in a lateral direction *and a vertical direction* of said connector *wherein said bottom retaining wall is inclined so as to be tapered in a second direction opposite said first direction.*

*11. A connector for retaining a pair of metal terminals each having an engagement portion provided therein, comprising:*

*a connector housing have an insertion hole and a pair of terminal receiving chambers provided therein for respectively receiving said terminals, said housing including a flexible retaining member extending into each of said terminal receiving chambers and being engageable with said engagement portion of a corresponding terminal when said corresponding terminal is in a completely retained position; and*

*a retaining reinforcement member insertable into said insertion hole of said connector housing in a first direction, said reinforcement member having a pair of grooves provided therein each defined by opposing retaining walls and a bottom retaining wall, said flexible retaining members being respectively disposed within said pair of grooves and being retained between said retaining walls when said terminals are in said completely retained position to prevent movement of said flexible retaining members in a lateral direction and a vertical direction of said connector, wherein said opposing retaining walls and said bottom retaining wall are planar such that said grooves have a rectangular U-shape, and wherein said bottom retaining wall is inclined so as to be tapered in a second direction opposite said first direction.*

*12. The connector of claim 11, wherein a distal end of each of said retaining members is engageable with said engagement portion of said corresponding terminal.*

*13. The connector of claim 11, wherein said reinforcement member includes a pair of stepped surfaces disposed perpendicular to said retaining walls for respectively abutting against said terminals to prevent longitudinal movement of said terminals further into said receiving chambers.*

*14. The connector of claim 11, wherein said retaining reinforcement member is retainable in a provisionally retained position disposed partially in said insertion hole of said connector housing and said completely retained position disposed completely in said insertion hole.*

*15. A connector for retaining a metal terminal having an engagement portion provided therein, comprising:*

*a connector housing have an insertion hole and a terminal receiving chamber provided therein for receiving said terminal, and including a flexible retaining member formed thereon and being engageable with said engagement portion of said terminal when said terminal is in a completely retained position; and*

*a retaining reinforcement member insertable into said insertion hole of said connector housing, said reinforcement member having a groove provided therein defined by opposing planar retaining walls and a bottom planar retaining wall, wherein when said terminal is in said completely retained position said flexible retaining member is disposed within said groove so as to be retained between said retaining walls and supported by said bottom retaining wall to prevent movement of said flexible retaining member in a lateral direction and a vertical direction of said connector, wherein said retaining reinforcement member includes a stepped surface disposed perpendicular to said retaining walls for abutting against said terminal when said terminal and said reinforcement member are in said completely retained position.*

*16. A connector for retaining a pair of metal terminals each having an engagement portion provided therein, comprising:*

*a connector housing have an insertion hole and a pair of terminal receiving chambers provided therein for respectively receiving said terminals, said housing including a flexible retaining member extending into each of said terminal receiving chambers and being engageable with said engagement portion of a corresponding terminal when said corresponding terminal is in a completely retained position; and*

*a retaining reinforcement member insertable into said insertion hole of said connector housing, said reinforcement member having a pair of grooves provided therein each defined by opposing retaining walls and a bottom retaining wall, said flexible retaining members being respectively disposed within said pair of grooves and being retained between said retaining walls when said terminals are in said completely retained position to prevent movement of said flexible*

*retaining members in a lateral direction and a vertical direction of said connector, wherein said reinforcement member includes a pair of stepped surfaces disposed perpendicular to said retaining walls for respectively abutting against said terminals when said terminals and said reinforcement member are in said completely retained position.*

* * * * *